US006196245B1

(12) United States Patent
Eastman

(10) Patent No.: US 6,196,245 B1
(45) Date of Patent: Mar. 6, 2001

(54) SCREENED ARBOR

(76) Inventor: Robert Eastman, 1232 Briarcliffe, Flint, MI (US) 48532

( * ) Notice: Subject to any disclaimer, the term of this patent is extended or adjusted under 35 U.S.C. 154(b) by 0 days.

(21) Appl. No.: 09/390,163

(22) Filed: Sep. 3, 1999

(51) Int. Cl.[7] ..... E04H 15/34
(52) U.S. Cl. ..... 135/121
(58) Field of Search ..... 135/121, 128, 135/87, 90, 117

(56) References Cited

U.S. PATENT DOCUMENTS

| | | | | |
|---|---|---|---|---|
| 459,764 | * | 9/1891 | Orr, Sr. | 135/90 |
| 1,900,274 | * | 3/1933 | Brockie | 135/90 |
| 2,137,625 | * | 11/1938 | Norvell | 135/117 |
| 4,084,598 | * | 4/1978 | Rainwater | 135/907 |
| 5,117,853 | * | 6/1992 | Pruesner | 135/121 |
| 5,490,532 | * | 2/1996 | Mallookis et al. | 135/117 |
| 5,634,483 | * | 6/1997 | Gwin | 135/87 |
| 5,806,547 | * | 9/1998 | Derlinga | 135/117 |
| 6,009,891 | * | 1/2000 | Surface et al. | 135/90 |

* cited by examiner

*Primary Examiner*—Alvin Chin-Shue
*Assistant Examiner*—Sarah Purol

(57) ABSTRACT

The subject invention discloses an arbor comprising a frame having at least three wall supports attachable to each other, at least three legs, each leg attachable to the wall supports, a removable cover which overhangs the wall supports, and a plurality of side panels which may include mesh areas and zippered openings to allow access to the interior of the arbor. The side panels may be provided with anchoring strips to anchor the arbor to the ground. Each of the side panels may be removably attachable to an appropriate portion of the cover by means including a hook and loop strip appropriately disposed on adjacent edges of these components. Further, the arbor may also comprise roof supports where a peaked arbor is desired. The wall supports, roof supports, and legs may all be formed of respective members which can be selectively connectable to each other for length when the arbor is in use or detached from each other for convenience in storage and transportation. The wall supports may be connectable to each other and to respective roof supports and legs by wall joints which may provide a plurality of hollow tubes sized to selectively receive an end of the appropriate roof member, wall member, or leg. Similarly, a peak joint may be comprised of a backing and a plurality of tubes having hollowed ends adapted to receive the mating ends of the roof support.

12 Claims, 2 Drawing Sheets

FIG 1
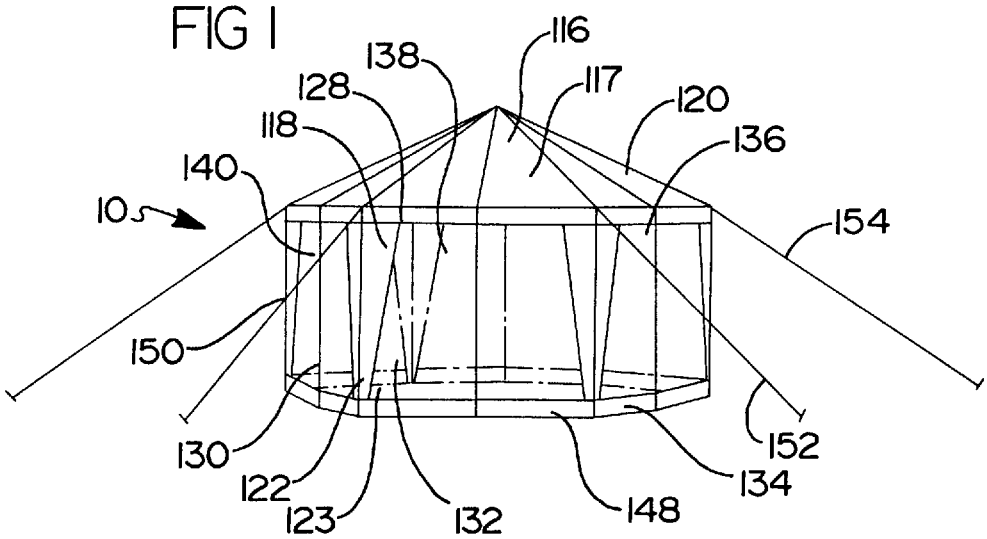
FIG 2
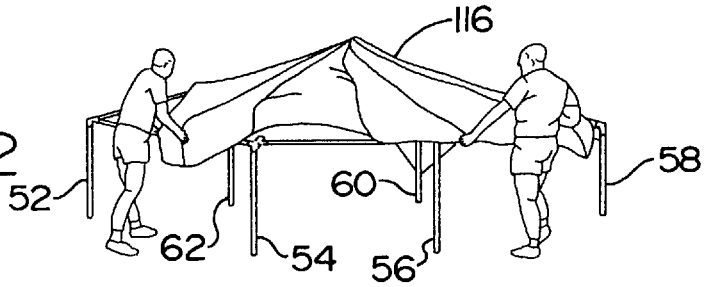
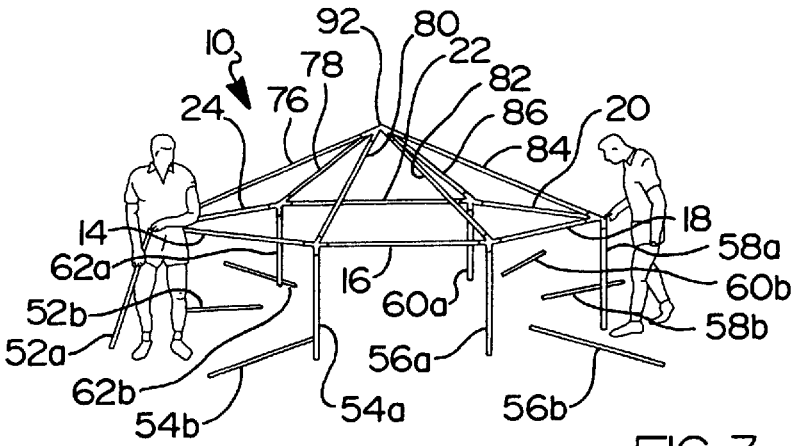
FIG 3

SCREENED ARBOR

CROSS-REFERENCE TO RELATED APPLICATION

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

FIELD OF THE INVENTION

The present invention relates to arbors. More particularly, the present invention relates to arbors with removable panels. Even more particularly, the present invention relates to screened arbors having removable panels that have anchor strips.

SUMMARY OF THE INVENTION

Arbors are used to provide temporary shelter and shade for people, typically for such leisure activities as picnics and the like. Arbors are of two general types, open and screened. Open arbors comprise a frame and a removable cover; in addition to a frame and a cover, screened arbors have screen panels; that are removably attachable to the cover.

Difficulties with prior art screened arbors include difficult attachment and removal of panels, and ground anchors that are weak or that tear easily. The present invention addresses both these issues.

The invention hereof, generally, comprises a screened arbor. The screened arbor, generally, comprises:

(a) a frame, the frame comprising:
  (i) at least three wall supports, the wall supports removably attachable to each other;
  (ii) at least three legs, the legs removably attachable to the wall supports;
  (iii) means for removably attaching the wall supports to each other;
  (iv) means for removably attaching the legs to the wall supports;

(b) a removable cover disposed upon and overhanging the wall supports, the cover having a peripheral edge, a first surface, and an opposed second surface, the cover having a hook-and-loop strip disposed on the first surface thereof proximate the peripheral edge and parallel thereto; and (c) a plurality of panels, each of the plurality of panels having a top edge, a bottom edge, two spaced apart side edges extending between the top edge and the bottom edge, a first surface, and an opposed second surface, each of the plurality of panels having a hook-and-loop strip disposed on the second surface thereof proximate the top edge and parallel thereto for detachably connecting the panel to the cover, and an anchor strip disposed on the first surface thereof proximate the bottom edge and parallel thereto.

BRIEF DESCRIPTION OF THE SEVERAL VIEWS OF THE DRAWING

FIG. 1 is an environmental view of an arbor according to the present invention;

FIG. 2 is an environmental view of the arbor of FIG. 1 in a partially assembled state;

FIG. 3 is an environmental view of a frame of the arbor of FIG. 1 in a partially assembled state;

DETAILED DESCRIPTION OF THE INVENTION

Figure 4:
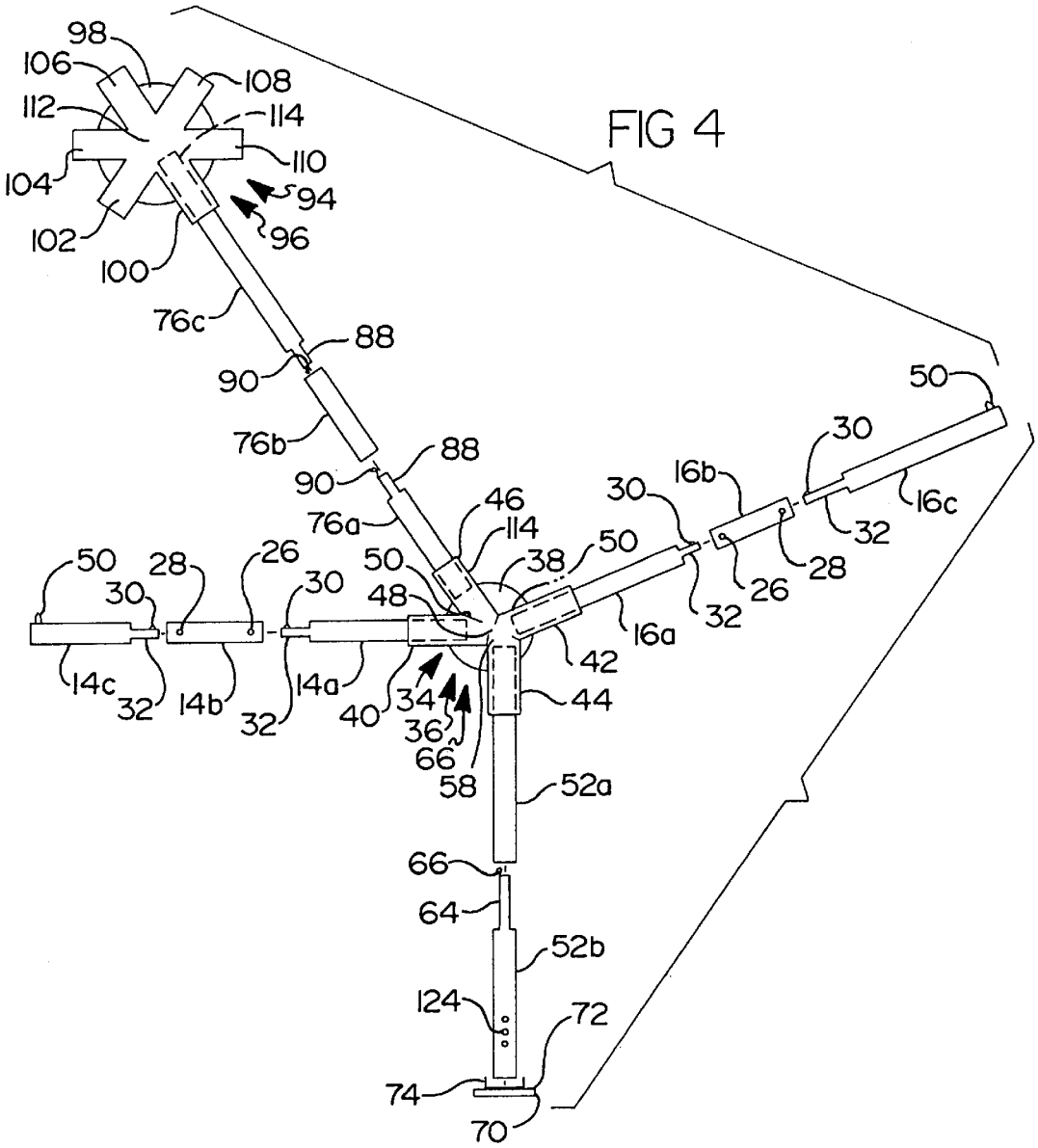
FIG. 4 is an partially exploded view of an arbor hereof, showing the interconnecting relationship between a corner joint, peak joint, wall supports, leg, foot pad, and roof support of the frame of FIG. 3.

With reference to the drawings, and in accordance herewith, there is provided a screened arbor, generally, denoted at 10. The arbor 10, generally, comprises a frame 12. The frame 12 comprises at least three wall supports; the example shown in the drawing and described herein has six wall supports 14, 16, 18, 20, 22, 24. Preferably, each of the wall supports is similarly constructed. Therefore, for purposes of brevity, only the wall support 14 will be described herein.

The wall support 14, preferably, comprises a first end wall support member 14*a*, a medial wall support member 14*b*, and a second end wall support member 14*c*. The end members 14*a*, 14*c* removably attach to the medial member 14*b* by any suitable means in forming the wall support 14. As shown in FIG. 4, preferably, each end member 14*a*, 14*c* has a reduced-diameter portion 32 at an end thereof, and the reduced-diameter portion slidably fits into the medial portion 14*b* and is frictionally held therein. Two apertures 26, 28 are formed through the medial member 14*b*, one proximate each end thereof, and each of the end members 14*a*, 14*c* has a spring-loaded button clip 30 disposed on the reduced-diameter portion 32 thereof proximate an end thereof, with the spring extending between and attached to the clip and the reduced-diameter portion 32; the reduced-diameter portions of the end members 14*a*, 14*c* are slidably inserted into the medial member until the button of each of the button clips pops out through one of the apertures in the medial member 14*b*. Alternately, other means for removable attachment of members 14*a*, 14*b* and 14*c* may be used, such as appropriate threadings on the end members and medial member, or fastened connections using fasteners such as screws or the like.

Each of the end wall support members 14*a*, 14*c* and the medial wall support member 14*b* is, preferably, hollow and made of a strong material such as steel, though other materials such as aluminum, plastic, or the like may be used as desired if sufficiently strong. Hollow members are preferred because they typically weigh less than do solid members, though solid members may also be used, except for the portions of the medial member 14*b* into which the end members 14*a*, 14*c* insert. Alternately, the wall support 14 may be a single unitary member or a single member with fixable telescoping portions.

The wall support 14 may, optionally, further comprise at least one triangle clip 50. Each triangle clip 50 is disposed on the wall support 14 proximate an end thereof and is affixed thereto by any suitable means, such as welding or the like. The triangle clip 50 is used to help stabilize the connection of the wall support 14 to a corner joint, as described below. Other stabilizers 50 known to the art may alternatively be used in place of triangle clip 50.

The wall supports are arranged in a planar closed shape, such as a triangle, a rectangle, a hexagon, or the like, the shape of each arbor being governed by corner joints as described below. FIGS. 1–3 show a hexagonal configuration for the wall supports; however, it is to be understood that other closed shapes may be utilized as well, and that a square configuration as well as a hexagon configuration, is commonly used.

The frame 12 further comprises means 34 for removably attaching the wall supports 14 to each other. The means 34, preferably, comprises at least three corner joints, such as the corner joint 36 shown in FIG. 4. The number of corner joints equals the number of wall supports. Preferably, each of the corner joints is similarly constructed. Therefore, for purposes of brevity, only the corner joint 36 will be described herein.

The corner joint 36 comprises a backing 38 and a plurality of hollow tubes 40, 42, 44, 46. Each of the tubes has a first open end and a second open end, with the first ends of the tubes being coincident with each other at a common area 48, as shown in FIG. 4. The tubes are angularly disposed relative to each other to accommodate the desired shape of the frame, with one wall support 14 or other element slidably fitting into the second end of each of the hollow tubes 40, 42, 44 and 46 as described below. The comer joints are, preferably, made of nylon, though similar materials may be used if desired.

As noted above, the wall support 14 may, optionally, comprise at least one stabilizer or triangle clip 50 disposed on the wall support 14 proximate an end that inserts into the corner joint 36. The triangle clip 50 is compressed as the wall support 14 is inserted into the corner joint 36, then is released when the wall support is pushed sufficiently into the corner joint that the triangle clip 50 is disposed in the common area 48 of the corner joint 36; the released triangle clip thus adds to the stability of the attachment of the wall support to the corner joint.

The frame 12 further comprises at least three legs; the example shown in the drawing and described herein has six legs 52, 54, 56, 58, 60, 62. The number of legs equals the number of corner joints, which equals the number of wall supports. Preferably, each of the legs is similarly constructed. Therefore, for purposes of brevity, only the leg 52 will be described herein.

The leg 52 comprises at least a first leg member 52*a* and a second leg member 52*b*. Preferably, the second end member has at least one aperture 124 formed therein for removable attachment of a cover extension, as described below. The first and second leg members 52*a* and 52*b* respectively, are removably attachable to each other by any suitable means in forming the leg 52. As shown in FIG. 4, preferably, the second member 52*b* has a reduced-diameter portion 64 at an end thereof, and the reduced-diameter portion slidably fits into the first portion 52*a* and is frictionally held therein. Optionally, a spring-loaded curly clip 66 is attached to the reduced-diameter portion 64 of the second member 52*b*, With the spring extending between and attached to the clip 66 and the reduced-diameter portion 64, and is compressed when the reduced-diameter portion 64 is inserted into the first member 52*a*; this increases the frictional stability of the connection of the second member 52*b* to the first member 52*a*. Alternatively, other means for removable attachment may be used, such as appropriate threadings on the leg members 52*a* and 52*b*. When the leg members are assembled to each other, the legs 52, 54, 56, 58, 60 and 62 are the same length as each other.

Each of the first and second leg members 52*a*, 52*b* is, preferably, hollow and made of a strong material such as steel, though other materials such as aluminum, plastic, or the like may be used as desired if sufficiently strong. Hollow members are preferred because they typically weigh less than do solid members, though solid members may also be used except for the portions of the first leg member 52*a* into which the second leg member 52*b* inserts. Alternately, the leg 52 may be a single unitary member or a single member with fixable telescoping portions.

The leg 52 may, optionally, further comprise a stabilizer or triangle clip 68. The triangle clip 68 is disposed on the first leg member 52*a* proximate an end thereof and is affixed thereto by any suitable means, such as welding or the like. The triangle clip 68 is used to help stabilize the connection of the leg to a corner joint, as described below.

The legs 52, 54, etc., are attached to the rest of the frame by means 66 for removably attaching the legs to the wall supports. The means 66 are, preferably, the corner joints 36. The first member 52*a* of each of the legs 52, etc., slidably fits into one of the hollow tubes 44 of a respective one of the corner joints 36, analogously to the end portions of the wall supports fitting into other hollow tubes 40, 42 of the corner joints as described above.

As noted above, the leg 52 may, optionally, comprise a stabilizer or triangle clip 68. The stabilizer or triangle clip 68 is disposed on the first leg member 52*a* proximate the end that inserts into the comer joint 36. The triangle clip 68 is compressed as the leg is inserted into the corner joint 36, then is released when the leg is pushed sufficiently into the corner joint that the triangle clip 68 is disposed in the common area 48 of the corner joint 36; the released triangle clip 68 thus adds to the stability of the attachment of the leg to the corner joint.

A foot pad 70 is, preferably, removably attachable to each leg 52, etc. Each foot pad 70 has a planar portion 72 and a tubular portion 74 projecting from the planar portion 72 normal thereto. The inner diameter of the tubular portion 74 is slightly greater than the outer diameter of the second portion 52*b* of the leg 52, such that the leg can be pressed into the tubular portion of the foot pad 70 and frictionally held therein. The foot pads 70 are, preferably, made of nylon, though similar materials may be used if desired.

Optionally, and preferably, the frame 12 further comprises at least three roof supports; the example shown in the drawing and described herein has six roof supports 76, 78, 80, 82, 84, 86. If present, the roof supports 76, etc., provide for a peaked roof for the arbor 10, which is often preferred to a flat roof in the marketplace. If roof supports 76, etc., are used, the number of roof supports equals the number of corner joints, which equals the number of wall supports . Preferably, each of the roof supports 76, etc., is similarly constructed. Therefore, for purposes of brevity, only the roof support 76 will be described herein.

The roof support 76, preferably, comprises a first end roof support member 76*a*, a medial roof support member 76*b*, and a second end roof support member 76*c*. The end roof support members 76*a*, 76*c* removably attach to the medial member 76*b* by any suitable means in forming the roof support 76. As shown in FIG. 4, preferably, each end roof support member has a reduced-diameter portion 88 at an end thereof, and the reduced-diameter portion slidably fits into the medial portion 76*b* and is frictionally held therein. Optionally, a spring-loaded curly clip 90 is attached to the reduced-diameter portion 88 of each end member, with the spring extending between and attached to the clip 90 and the reduced-diameter portion 88, and is compressed when the reduced-diameter portion 88 is inserted into the medial member 76*b*; this increases the frictional stability of the connection of the end member 76*a* or 76*c* to the medial member 76*b*. Alternately, other means for removable attachment may be used, such as appropriate threadings on the end members and medial member, or fastened connections using fasteners such as screws or the like.

Each of the roof support end members 76*a*, 76*c* and the medial member 76*b* is, preferably, hollow and made of a strong material such as steel, though other materials such as aluminum, plastic, or the like may be used as desired if sufficiently strong. Hollow members are preferred because they typically weigh less than do solid members, though solid members may also be used except for the portions of the medial member 76*b* into which the end members 76*a*, 76*c* insert. Alternately, the roof support 76 may be a single unitary member or a single member with fixable telescoping portions.

As with the wall support 14, the roof support 76 may further comprise at least one stabilizer or triangle clip 114 disposed at an end thereof and affixed thereto by any suitable means, such as welding or the like, to help stabilize the connection of the roof support 76 to other elements, as described below.

One of the end members of each roof support 76, etc., slidably fits into a hollow tube 46 of a corresponding one of the corner joints 36. The roof supports rise from the corner joints to a space 92 above the center of the planar closed shape of the wall supports. In a peaked hexagon configuration, for instance, there are six wall supports 14, 16, 18, 20, 22, 24 cooperating to define the circumference of a hexagon and six roof supports 76, 78, 80, 82, 84, 86 extending from the corner joints to the space 92 above the center of the hexagon, as shown in FIG. 3.

If roof supports are used, the frame 12 further comprises means 94 for removably attaching the roof supports to each other, such as the peak joint 96 shown in FIG. 4 for a hexagonal peaked roof. The peak joint 96 is constructed similarly to the corner joint 36 described above. The peak joint 96 comprises a backing 98 and a plurality of hollow tubes 100, 102, 104, 106, 108, 110. Each of the tubes 100, etc., has a first end and a second end, with the first ends of the tubes being coincident with each other at a common area 112, as shown in FIG. 4, and the second ends being open. The tubes are angularly disposed relative to each other to accommodate the desired shape of the roof, with one of the end portions 76*c* of each roof support 76, etc., slidably fitting into the second end of a corresponding one of the hollow tubes 100 etc., of the peak joint 96. The peak joint 96 is, preferably, made of nylon, though similar materials may be used if desired. The peak joint 96 is, preferably, unitarily formed, though the backing and the tubes may be formed separately and attached to each other via sonic welding or the like if desired.

As noted above, and similarly to the wall support 14, the roof support 76 may comprise stabilizers or triangle clips 114 that increase the stability of the attachment of the roof support 76 to the peak joint 96 and to the corner joint 36.

Disposed upon the frame is a cover 116. The cover 116 has a first surface 117, an opposed second surface, and a peripheral edge 118. When the arbor 10 is assembled, the first surface 117 of the cover 10 faces outwardly, i.e. not toward the center of the arbor. The cover 116 is of sufficient size and shape to cover the wall supports 14, etc., and, if present, the roof supports 76, etc., and overhang the wall supports on all sides, as shown in FIGS. 1 and 2. A hook-and-loop strip 128 is attached to the first surface 117 of the cover 116, in the well-known manner around the entire periphery of the cover 116 proximate the edge 118. The hook-and-loop strip 128 is used to attach panels to the cover 116, as described below.

Preferably, the cover 116 has a main portion 120 and a plurality of extensions 122. The cover extensions 122 may be unitarily formed with the main portion 120 of the cover, sewn thereonto, sonically welded thereonto, or otherwise attached to the main portion 120 of the cover. The number of cover extensions 122, preferably, equals the number of legs, as one extension removably attaches to each leg 52, etc., as described below. Each cover extension 122, preferably, has at least one hook-and-loop strip 123 attached thereto in the well-known manner on the first surface 117 thereof for removable attachment of at least one panel, as described below. Each cover extension 122 projects from the main portion 120 of the cover adjacent to the legs and attaches to a corresponding leg 52, etc., at the second portion 52*b* thereof, as shown in FIG. 1. Preferably, and as noted above, the second member 52*b* of each leg 52, etc., has at least one aperture 124 formed therein spaced from the area of the second member 52*b* covered by the footpad 70, as shown in FIG. 4. A hook (not shown) removably attaches the cover extension 122 to the leg 52, etc., by hooking into one of the apertures 124 in the second portion 52*a* of the leg. The hook may be a part of the cover extension 122 or the hook may be a separate piece, as desired; if the hook is a separate piece, the cover extension 122 has a suitable aperture formed therethrough through which the hook may project when the hook hooks into the aperture 124 in the leg 52, etc.

The cover 116 is, preferably, formed of heavy duty polyethylene, though other similarly strong and lightweight materials may also be used.

Figure 5:
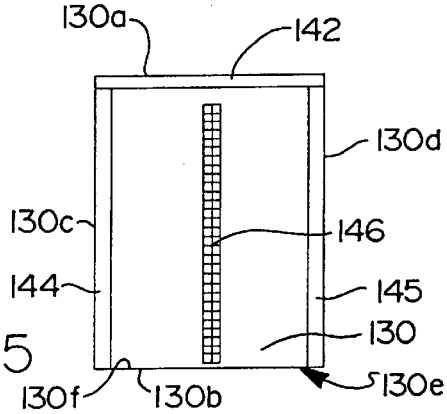
FIG. 5 is a side view of a panel of the arbor of FIG. 1.

The arbor 10 further comprises at least three removable panels; the example shown in the drawing and described herein has six panels 130,132,134, 136,138, 140. The number of these side panels equals the number of wall supports. The panels are all similarly formed; accordingly, the panel 130 will be used as an exemplar herein. At least one of panels 130, etc., includes a mesh area made of a metal or plastic mesh, with the mesh being of fine enough size that most flying insects cannot fly therethrough. The panel including the mesh area may be a unitary mesh member, son long as other requisite components described herein may be included on the mesh panel. The panels 130, etc., is, preferably, rectangular in shape, though other shapes may be used as desired, and is at least as long as each of the legs 52, etc. As shown in FIG. 5, the panel 130 has a top edge 130*a*, a bottom edge 130*b*, two spaced apart side edges 130*c*, 130*d* extending between the top edge and the bottom edge, a first surface 130*e*, and an opposed second surface 130*f*. When the arbor 10 is assembled, the first surface 130*e* faces outwardly, i.e. not toward the center of the arbor. A hook-and-loop strip 142 is attached to the panel 130 in the well-known manner on the second surface 130*f*, thereof proximate the top edge 130*a* thereof and extending along the length of the top edge 130*a* thereof. Preferably, hook-and-loop strips 144, 145 are also attached to the panel in the well-known manner on the second surface 130*f* thereof proximate each of the side edges 130*c*, 130*d* thereof and extending along the length thereof. The hook-and-loop strip 142 along the top edge of the panel 130 is used to attach the panel to the cover 116 via attachment to the hook-and-loop strip 128 in the well-known manner. Similarly, the hook-and-loop strips 144, 145 proximate the side edges of the panel 130 are used to attach the panel 130 to cover extensions 122 via attachment to the hook-and-loop strips 123 on the cover extensions 122 in the well-known manner.

One or more of the panels 130, etc., may have a zipper 146 extending from the bottom edge 130*b* to the top edge 130*a*, or from a point recessed from the bottom edge 130*b* thereof to a point recessed from the top edge 130*a* thereof as desired, to allow ingress and egress through the panel 130.

As shown in FIG. 1, an anchor strip 148 is secured to the first surface 130*e* of each panel 130, etc., proximate the bottom edge 130*b* thereof along the entire extent thereof. The anchor strip 148 is, preferably, formed of polyethylene or a similarly strong material, with at least one or more suitable apertures formed therethrough for staking the arbor 10 to the ground in the well-known manner.

Alternately, the hook-and-loop strip 142 on the panels 130, etc., may be disposed on the first surfaces 130*e*; that, in turn, would necessitate the hook-and-loop strips 128 on the cover being disposed on the second surfaces thereof to effect removable attachment between the panels 130 and the cover 116 via the hook-and-loop strips.

Preferably, the arbor 10 further comprises a plurality of spaced apart guy ropes projecting from the main portion 120 of the cover 116, such as those depicted at 150, 152, and 154 in FIG. 1, each guy rope 150, etc., shaped such that an aperture is formed at an end of the guy rope opposite the cover 116 to assist in staking the arbor 10 to the ground in the well-known manner.

In use, the frame 12 is assembled by the following steps. First, each wall support 14, etc. is assembled by inserting the two end portions 14*a*, 14*c*, etc. thereof into the medial portion 14*b*, etc. thereof until the spring-loaded button clips 30 of the end portions project through the apertures 26, 28 of the medial portion. Second, the wall supports 14, etc. are assembled into the desired shape by inserting them into tubes 40, 42 of the corner joints 36 until the stabilizers or triangle clips 50 are released in the common areas 48 of the corner joints 36. Third, the end portions 76*a*, etc. of the roof supports 76, etc. are inserted into the tubes 100, 102, 104, 106, 108, 110 of the peak joint 96 until the triangle clips 114 are released in the common area 112 of the peak joint 96. Fourth, the reduced-diameter portion 88 of each of the end portions 76*a*, etc. of the roof supports 76, etc. are inserted into a corresponding roof support medial portion 76*b*, etc. Fifth, the reduced-diameter portion 88 of each of the end portions 76*c*, etc. of the roof supports 76, etc. are inserted into a corresponding roof support medial portion 76*b*, etc. Sixth, the end portions 76*c*, etc. of the roof supports 76, etc. are inserted into tubes 46 of the corner joints 36 until the triangle clips 114 are released in the common areas 48 of the corner joints 36. Seventh, the first leg portions 52*a*, etc. of the legs 52, etc. are inserted into tubes 44 of the corner joints 36 until the triangle clips 68 are released in the common areas 48 of the corner joints 36. Eighth, the reduced-diameter portion 64 of each of the first leg portions 52*a*, etc. are inserted into a corresponding second leg portion 52*b*, etc. Ninth, each footpad 70 is attached to a corresponding second leg portion 52*b*, etc. by pushing the second leg portions into the tubular portions 74 of the footpads 70. Tenth, the cover 116 is emplaced over the roof supports 76, etc. and the wall supports 14, etc. and the cover 116 is pulled tight, as shown in FIG. 2, such that the cover 116 overhangs the wall supports 14, etc. on all sides. Eleventh, the cover extensions 122 are pulled down alongside the legs and each cover extension 122 is hooked to the second portion of a corresponding leg by connecting hooking the hook on the cover extension 122 into one of the apertures 124 in the second portion of the leg. Twelfth, the panels 130, etc. are attached to the cover 116 via the hook-and-loop strips 142, 128, 144, 145, 123. The arbor 10 is now fully assembled. The arbor may be anchored to the ground by pounding stakes (not shown) through the apertures in the anchor strips 148 on the panels into the ground, and by pounding stakes (not shown) through the apertures in the guy ropes 150, etc. into the ground, in the well-known manner.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

What is claimed:

1. An arbor comprising:

(a) a frame, the frame having:

(i) at least three wall supports, each of the wall supports removably attachable to two of the other wall supports;

(ii) at least three legs, each of the legs removably attachable to the wall supports;

(iii) means for removably attaching each of the wall supports to two of the other wall supports;

(iv) means for removably attaching each of the legs to the wall supports;

(b) a removable cover disposed upon and overhanging the wall supports, the cover having a peripheral edge, a first surface, and an opposed second surface, the cover also having a hook-and-loop strip disposed on the first surface proximate the peripheral edge;

(c) a plurality of panels, each of the plurality of panels having a top edge, a bottom edge, two spaced-apart side edges extending between the top edge and the bottom edge, a first surface, and an opposed second surface, each of the plurality of panels also having a hook-and-loop strip disposed on the second surface proximate the top edge for detachably connecting the panel to the cover;

(d) at least three roof supports, each roof support comprising a plurality of roof support members, each member having at least one end selectively connectable to at least one end of another roof support member, and at least one of the support members has a reduced diameter portion at at least one end thereof, which reduced diameter portion comprises a spring clip that removably engages an end of another roof support member to enhance stability of the engagement of the reduced diameter portion to the end of the other roof support member; and (e) means for removably attaching each of the roof supports to the other roof supports.

2. The arbor of claim 1 wherein each of the plurality of panels further comprises an anchor strip disposed on the first surface proximate the bottom edge and parallel thereto.

3. The arbor of claim 2 wherein the anchor strip further comprises at least one aperture for staking the arbor to the ground.

4. The arbor of claim 1 wherein at least one of the plurality of panels further comprises a zipper extending generally from the top edge to the bottom edge to allow ingress and egress through the panel.

5. The arbor of claim 1 wherein at least one of the plurality of panels further comprises a mesh area.

6. The arbor of claim 1 wherein the cover further comprises a main portion and a plurality of cover extensions extending from the main portion, each of the plurality of cover extensions removably attachable to one of the legs.

7. The arbor of claim 6 wherein each of the plurality of cover extensions further comprises a hook adapted to removably attach each of the cover extensions to one of the legs.

8. The arbor of claim 1 wherein each of the legs further comprises a plurality of leg members each member having at least one end selectively connectable to at least one end of another leg member.

9. The arbor of claim 8 wherein at least one of the leg members has a reduced diameter portion at at least one end thereof, which reduced diameter portion removably engages an end of another leg member.

10. An arbor comprising:

(a) a frame, the frame having:

(i) at least three wall supports, each of the wall supports removably attachable to two of the other wall supports;

(ii) at least three legs, each of the legs removably attachable to the wall supports;

(iii) means for removably attaching each of the walls supports to two of the other wall supports;

(iv) means for removably attaching each of the legs to the wall supports;

(b) a removable cover disposed upon and overhanging the wall supports, the cover having a peripheral edge, a first surface, and an opposed second surface, the cover also having a hook-and-loop strip disposed on the first surface proximate the peripheral edge;

(c) a plurality of panels, each of the plurality of panels having a top edge, a bottom edge, two spaced-apart side edges extending between the top edge and the bottom edge, a first surface, and an opposed second surface, each of the plurality of panels also having a hook-and-loop strip disposed on the second surface proximate the top edge for detachably connecting the panel to the cover;

(d) at least three roof supports, each roof support comprising a triangle clip; and (e) means for removably attaching each of the roof supports to the other roof supports, said means for removably attaching comprising a peak joint having a backing and a plurality of tubes, each tube having an open end adapted to removably receive an end of each roof support, and said triangle clip being adapted to be removably connected to the peak joint.

11. An arbor comprising:

(a) a frame, the frame having:

(i) at least three wall supports, each of the wall supports being removably attachable to two of the other wall supports and comprises a triangle clip;

(ii) at least three legs, each of the legs removably attachable to the wall supports;

(iii) means for removably attaching each of the wall supports to two of the other wall supports, said means for removably attaching comprising a corner joint adapted to be removably connected to the triangle clip and having a backing and a plurality of tubes, each tube having an open end adapted to removably receive an end of each wall support, and (iv) means for removably attaching each of the legs to the wall supports;

(b) a removable cover disposed upon and overhanging the wall supports, the cover having a peripheral edge, a first surface, and an opposed second surface, the cover also having a hook-and-loop strip disposed on the first surface proximate the peripheral edge; and (c) a plurality of panels, each of the plurality of panels having a top edge, a bottom edge, two spaced-apart side edges extending between the top edge and the bottom edge, a first surface, and an opposed second surface, each of the plurality of panels also having a hook-and-loop strip disposed on the second surface proximate the top edge for detachably connecting the panel to the cover.

12. An arbor comprising:

(a) a frame, the frame having:

(i) at least three wall supports, each of the wall supports being removably attachable to two of the other wall supports and comprising a plurality of wall support members, each wall support member having at least one end selectively connectable to at least one end of another wall support member, at least one of the wall support members having a reduced diameter portion at at least one end thereof, which reduced diameter portion removably engages an end of another wall support member and comprises a spring loaded button clip to enhance stability of ther engagement of the reduced diameter portion to the end of the other wall support member;

(ii) at least three legs, each of the legs removably attachable to the wall supports;

(iii) means for removably attaching each of the wall supports to two of the other wall supports;

(iv) means for removably attaching each of the legs to the wall supports;

(b) a removable cover disposed upon and overhanging the wall supports, the cover having a peripheral edge, a first surface, and an opposed second surface, the cover also having a hook-and-loop strip disposed on the first surface proximate the peripheral edge; and (c) a plurality of panels, each of the plurality of panels having a top edge, a bottom edge, two spaced-apart side edges extending between the top edge and the bottom edge, a first surface, and an opposed second surface, each of the plurality of panels also having a hook-and-loop strip disposed on the second surface proximate the top edge for detachably connecting the panel to the cover.

* * * * *